US006644472B2

(12) United States Patent
Coppedge et al.

(10) Patent No.: US 6,644,472 B2
(45) Date of Patent: Nov. 11, 2003

(54) FOOTWEAR PACKAGE

(75) Inventors: Johnny Coppedge, West Linn, OR (US); Salvatore Cesario, West Linn, OR (US)

(73) Assignee: See the Shoes, LLC

( * ) Notice: Subject to any disclaimer, the term of this patent is extended or adjusted under 35 U.S.C. 154(b) by 0 days.

(21) Appl. No.: 09/966,542

(22) Filed: Sep. 25, 2001

(65) Prior Publication Data

US 2003/0057118 A1 Mar. 27, 2003

(51) Int. Cl.[7] ..... B65D 85/18

(52) U.S. Cl. ..... 206/278; 206/292; 206/511; 220/4.23

(58) Field of Search ..... 206/278, 292, 206/294, 461, 464, 467, 470, 471, 509, 511; 36/1; 220/4.22–4.24

(56) References Cited

U.S. PATENT DOCUMENTS

| | | | | | |
|---|---|---|---|---|---|
| 2,956,677 | A | * | 10/1960 | Kavadlo et al. | 206/464 |
| 3,369,660 | A | * | 2/1968 | Hartman | 206/294 |
| 3,407,961 | A | * | 10/1968 | Box | 206/511 |
| 3,414,093 | A | * | 12/1968 | Chostner | 36/1 |
| 4,244,508 | A | | 1/1981 | Schulman | |
| 4,795,029 | A | * | 1/1989 | Campbell et al. | 206/278 |
| 4,819,795 | A | | 4/1989 | Swaney | |
| D344,890 | S | | 3/1994 | Townes | |
| 5,293,993 | A | * | 3/1994 | Yates, Jr. et al. | 206/471 |
| 5,954,203 | A | * | 9/1999 | Marconi | 206/464 |
| 6,213,298 | B1 | | 4/2001 | Nguyen | |
| 6,305,533 | B1 | | 10/2001 | Welty et al. | |
| 6,321,911 | B1 | * | 11/2001 | Raimer et al. | 206/509 |

FOREIGN PATENT DOCUMENTS

| | | |
|---|---|---|
| JP | 59-12916 | 4/1984 |

* cited by examiner

*Primary Examiner*—Luan K. Bui
(74) *Attorney, Agent, or Firm*—ipsolon llp

(57) ABSTRACT

A container for holding a pair of shoes is formed in a blank having two body halves interconnected by a living hinge. The container body is at least partially clear to reveal a pair of shoes held in the interior. The interior of the container defines a space having non-uniform dimensions in which a pair of shoes is securely held. The container optionally includes an integrally formed carrying handle. Empty containers are nested to minimize shipping space. Each container includes stack stabilizing structure so that plural containers containing shoes may be stacked into stable stacks, and any selected container may be easily removed from the stack. The inventive container protects the shoes during shipping and storage, and displays the shoes both before and after sale.

21 Claims, 6 Drawing Sheets

FOOTWEAR PACKAGE

FIELD OF THE INVENTION

This invention relates to the field of packaging, and more particularly, packaging for footwear.

BACKGROUND

The market for consumer footwear is notoriously competitive and there are numerous footwear manufacturers competing for a share of that market. The intense level of competition in the footwear industry is found in nearly every market sector, and regardless of the particular type of shoe. However, the competition is perhaps most keenly focused in the market sector pertaining to active shoes and athletic shoes. In this market sector as well as others, competitors are constantly searching for ways to increase sales and market shares. Some of the most successful, and thus commonly used marketing techniques, are very familiar to most consumers. Examples include rapid introduction of new styles, product endorsements by famous athletes, intense brand name marketing and promotion, and advertising directed to specific consumer groups such as consumers falling into specific targeted demographic groups. These techniques along with other marketing activities help give footwear manufacturers a competitive edge in a highly competitive market.

Traditional shoeboxes are sometimes utilized for marketing purposes in addition to their more traditional function. Shoes of all types are usually packaged in traditional rectangular shoeboxes manufactured from some kind of paperboard, often cardboard. However, while such boxes serve an accepted functional role of storing and protecting the shoes, they do little to promote the product itself, other than minimal promotional information printed on the boxes.

While there are many different styles of shoeboxes, nearly all of them are variations on a standard theme: a rectangular box that is usually made of cardboard. Such boxes are useful for many reasons. From a purely functional point of view, rectangular shoeboxes provide a reasonably secure internal compartment for storing the shoes after manufacturing, and all the way from the factory to the consumer sales outlet. And traditional boxes are easily stacked, whether for shipping in containers from an offshore manufacturing location to a warehouse, for storage in a warehouse or a retail outlet, or for storing product for consumer inspection at warehouse-type retail outlets. While the internal compartment of a rectangular box is not custom designed to hold a pair of shoes, most shoes are held reasonably well in a standard box when the shoes are nested in the traditional opposed orientation, and generally with a paper sleeve inserted between the shoes to prevent them from rubbing together and scuffing.

But in addition to their functional benefits, traditional rectangular shoeboxes serve another purpose, and that is as a part of the marketing plan. Nearly all shoe manufacturers try to use their product packaging as part of their overall marketing programs designed to sell the product. Thus, many shoe manufacturers print graphics and other promotional information on their boxes. Even though this marketing information may be visible only on the sides of the boxes since boxes are usually stacked, the space can be used as advertising space. Moreover, the box may be printed with information about the shoes—sizes and the like.

However, there are several problems evident in traditional shoeboxes. First, the standard rectangular box design necessarily takes up more space than is needed to contain the shoes. Even when nested in an opposed orientation, a pair of shoes defines a shape that is seldom a regular rectangle, and as a result, most standard shoeboxes have excess materials and take up more space than is necessary. These factors increase costs of the product. For example, minimizing the amount of raw material used to make the box could reduce material costs tied up in the packaging. Likewise, eliminating excess packaging material that takes up added space can reduce shipping and storage costs.

Second, most shoeboxes are made of some form of paper—usually cardboard or a heavy paperboard. While such materials tend to make a relatively strong container, the can be crushed and are subject to moisture absorption and damage. Moisture damage to cardboard can be a significant problem. And even broken-down cardboard boxes designed for shoes tend to take up a significant amount of space. Further, the boxes must be manufactured in one location as blanks, shipped to another location where they are set up as boxes. Finally, raw material costs for cardboard are increasing at a steady rate, making the economics of using cardboard less and less favorable.

But perhaps the greatest shortcoming of traditional, rectangular shoeboxes is their limited ability to enhance product sales. As noted above, most shoe manufacturers print promotional information of one kind or another on their shoeboxes, including trademarks, logos and the like. This is valuable to a degree in selling the product. But cardboard is inherently opaque, and as such, a consumer must open the box to look at the shoes contained inside. Shoe manufacturers want their consumers to look at their shoes—the appearance of the shoe is an important factor in the consumer's decision on what to buy. It can be difficult to pull a box out of a stack of boxes, open it to look at the shoe, and then replace the shoe in the box in even a relatively neat fashion. Stated in another way, a large part of the consumer's buying decision is based upon the appearance of the shoe. As a result, shoe manufacturers spend a great deal of time and money in making their shoes look attractive to consumers—the manufacturers want consumers to see the product. But for all of this, shoes are almost always hidden in a shoebox.

There is a real need therefore for improved packaging containers for footwear.

The present invention provides a see-through display container for footwear that overcomes the problems in the prior art, and at the same time provides substantial marketing and product promotion advantages for shoe manufacturers. To name a few examples of the advantages that the inventive package provides to shoe makers, the container actually helps promote shoes and increase sales by presenting the product in a container that the consumer can see through. The product includes an integral handle so that the container itself functions as a carrying case for the enclosed product. This allows retailers to stop putting shoeboxes in bags, which of course are an unnecessary and thus wasteful expense. In addition, since the container is see-through, other consumers will be able to see what the purchaser has purchased. This is a further promotional tool.

In a preferred embodiment the present invention comprises a shoe container formed of a clear or translucent plastic that is formed such that a pair of shoes fits precisely into the interior of the container and is visible through the container. The container may be formed in any size to accommodate any sized shoe. The container of the present invention may be formed to define an interior space that conforms to the size and dimensions of a particular style of shoe. Thus, little space is wasted on both the interior and exterior and manufacturing, shipping and storage costs are minimized.

The shoes are oriented within the container in such a manner to ideally display the shoes to consumers. In a preferred embodiment, the shoes are oriented in the traditional toe-to-heel orientation, but such that the shoes are at a 90° angle with respect to one another rather than the traditional orientation where the shoes are oriented such that both shoes in a pair lie on their sides.

The containers are preferably thermoformed in a one-piece clamshell configuration that includes an integral hinge and carrying handle, although the container may be manufactured in two pieces that are interconnected when assembled. Empty containers may be nested so that storage space is minimized. When the containers are packaged with shoes, the halves of the clamshell package are closed over the shoes and are securely latched or interconnected to provide a secure package.

The outer dimensions of the containers are configured to include stack stabilization features so that multiple containers may be stacked in stable layers. Preferably, the containers include outwardly facing protrusions or rails that nest into a complimentary and cooperative structure in the next adjacent container when stacked. This allows a single container to be easily removed from a large stack of containers.

The container may be formed of many different types of plastics, including plastics containing significant levels of recycled materials. Many kinds of plastics used to make the inventive container may be recycled after use. The plastic may be colored to match the color scheme that the manufacturer has selected for the shoe, and the color of the container may thus be combined into a marketing plan. Written indicia such as brand names and logos may be printed on or formed in the container.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

A preferred embodiment of the footwear container of the present invention is shown in the FIGS. 1 through 6. The invention is described herein with respect to an exemplary design intended for use with conventional athletic shoes. However, the invention as defined in the appended claims is not limited to a container for athletic shoes. Those of ordinary skill in the art will instead recognize that the invention applies to containers for any kind of footwear.

Figure 1:
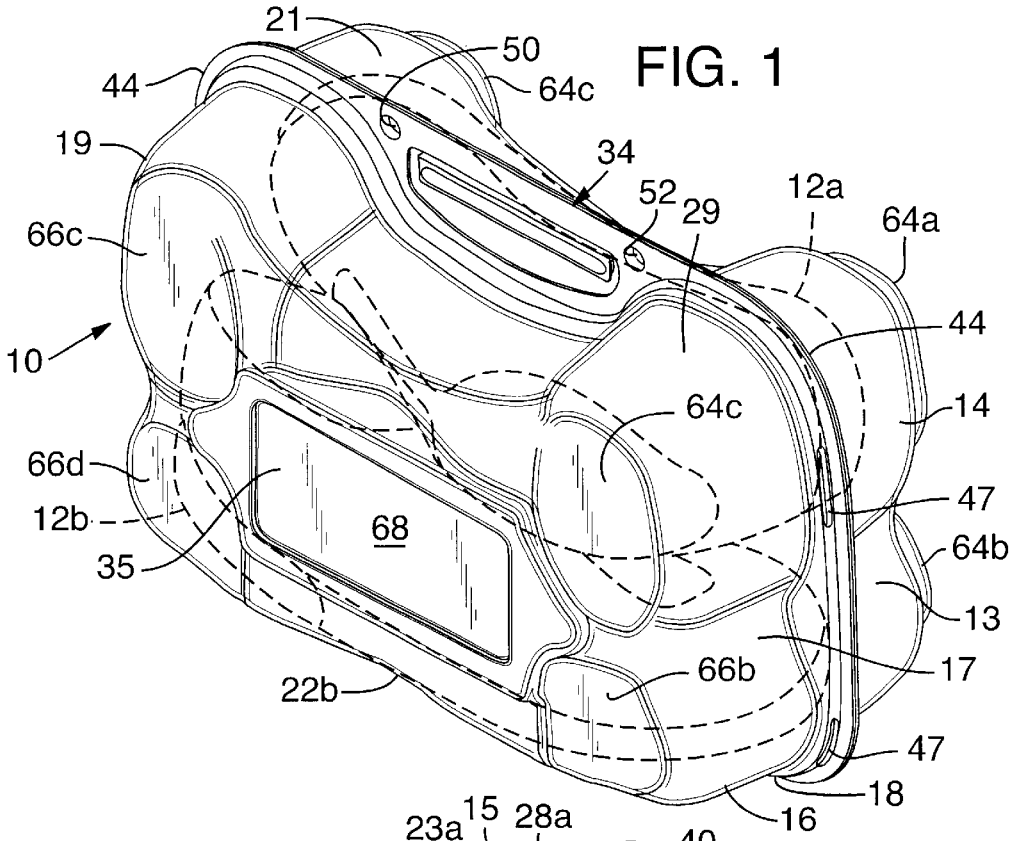
FIG. 1 is a perspective view of a footwear container according to the present invention, showing a pair of athletic shoes held within the closed container in phantom lines.

With reference to FIG. 1, container 10 is shown holding a pair of shoes 12 (the pair made up of shoe 12*a* and 12*b*) illustrated in broken, or phantom lines. Shoes 12 do not form a part of the present invention and are thus illustrated in all of the drawing figures in phantom lines. As described in more detail below, container 10 preferably is formed in two body halves, labeled 14 and 16, respectively, which are joined together and interconnected at a living hinge 18, meaning that the hinge is fabricated from the same material as the body halves, as opposed to being fabricated from a different material or in a different piece. Body halves 14 and 16 are sized to mate with one another when closed about hinge 18 the two halves lock together such that they define an interior space 20 configured for receiving a pair of shoes 12. Although the body halves are preferably formed in a unitary piece, each half comprises several structural panels that are separately identified herein for ease of reference. Thus, body half 14 has opposed lateral side panels 13 and 15. Body half 16 has corresponding lateral side panels 17 and 19. With half 14, the side panels are interconnected with a top panel 21 (adjacent the carrying handle described below), and a bottom panel 27 (adjacent hinge 18). Likewise, body half 16 has a top panel 29 and a bottom panel 31. Finally, the largest panel in each body half, or main panels are identified with reference numerals 33 (for body half 14) and 35 (for body half 16).

As detailed below, the two-body halves 14 and 16 respectively define a base unit and a lid that covers the base unit and which closes the halves together. While in the preferred embodiment the base (e.g. body half 14) and the lid (e.g. body half 16) are divided medially at hinge 18, so that each of the base and the lid contribute approximately the same amount of interior space, the two pieces may be divided from one another in any convenient manner and at any convenient location. For example, the base of the container could define the entire interior space 20 for holding a pair of shoes and the lid could simply close that space.

Container 10 is preferably fabricated from a clear material so that shoes 12 held within the container in space 20 are plainly visible through the container material. As used herein, the word "clear" refers to any transparent or translucent material used to fabricate the container and through which the pair of shoes 12 may be seen. Many materials may be used to fabricate the container. These include numerous grades of PET (polyethylene terephthalate), high density polyethylene (HDPE), low density polyethylene (LDPE), and vinyls such as various grades of polyvinyl chloride (PVC). Those or ordinary skill in the art will recognize that the material selected will depend upon the structural and cosmetic requirements of the particular package. Moreover, in a preferred embodiment the material selected for manufacturing the container will include a high percentage of recycled material.

The material may be clear, colored, or and any combination of coloring may be used. Moreover, portions of the container may be opaque so long as at least some of the container is clear to display the contents.

The container of the present invention is preferably formed using traditional thermoforming processes whereby a blank of material is pulled into a tool or mold, for instance with a vacuum, to form the container. Thermoforming processes are well known to those of skill in the art and need not be described herein. However, the container of the present invention may be formed using other well-known processes, such as injection molding, although the latter is more expensive and more difficult than thermoforming.

Figure 2:
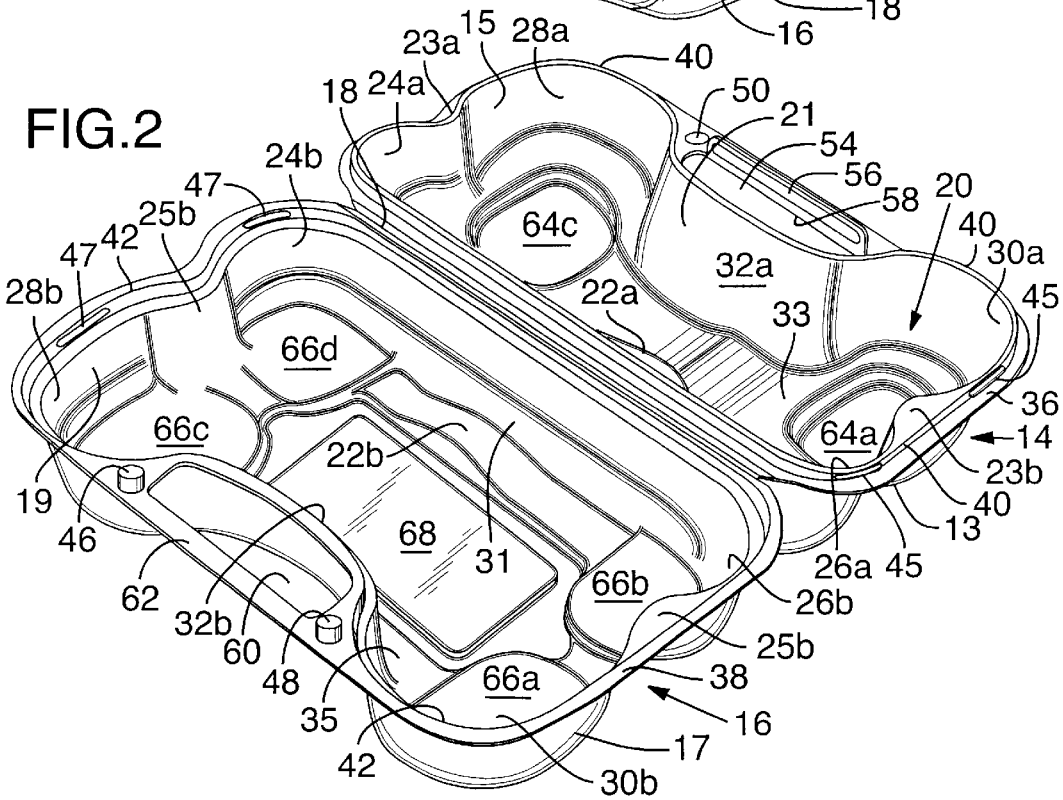
FIG. 2 is a perspective, top view of the footwear container shown in FIG. 1 with the container in an open.

Turning to the specific configuration of container 10, it will be seen in FIGS. 1 and 2 that the interior shoe-holding space 20 is configured to conform closely to the dimensions of the pair of shoes 12, and that the interior space (and outer surfaces of the container) are non-uniform in shape. The shoes are oriented in the container with respect to one another such that a customer can easily see each side of the shoes when inspecting the container, and without removing the shoes from the container. In the preferred orientation, the shoes are arranged in a toe-to-heel orientation with respect to one another. However, shoe 12*a* is rotated 90° along the longitudinal axis through the shoes with respect to shoe 12*b*. When this orientation is used, a consumer looking at the container through the half labeled 16 sees a side view of shoe 12*b* and a top view of shoe 12*a*. If the consumer turns the container around and looks through the body half labeled 14, the consumer sees the opposite side of shoe 12*b* and the bottom (or sole) of shoe 12*a*. The consumer may thus see each side of the shoes by looking at two sides of the container. Since the container is clear, the container does not need to be opened unless the consumer wants to try on the shoes.

The interior space 20 defined between body halves 14 and 16 when closed is non-uniform in shape and is configured to hold a pair of shoes snuggly. With reference to FIG. 2, body half 14 includes an inwardly curved instep portion 22*a* (which is partly obscured in the perspective view of FIG. 2) formed in bottom panel 27. Body half 16 includes an inwardly curved instep portion 22*b* formed in main panel 35. When shoe 12*b* is placed into interior space 20 as shown in FIG. 1 and the two halves of the container are closed (as in FIG. 1), the curved instep portions 22*a*, 22*b* rest on either side of the instep of the shoe. It will be appreciated that the relative terms "inward" and "outward" as used herein refer to the relative directions measured from the interior center of the closed container. It will further be appreciated that the particular shoe—shoe orientation illustrated in the Figures is by way of example only and that the shoes held within the container of the present invention may be oriented relative to one another in any manner, including the more traditional toe-to-heel orientation.

Similarly, each of the body halves 14 and 16 include opposed, inwardly projecting ribs 23*a* and 23*b*, and 25*a* and 25*b*, respectively formed in the opposed lateral side panels. Specifically, inwardly projecting rib 23*a* is formed in side panel 15 and rib 23*b* is located in side panel 13. With respect to body half 16, inwardly projecting ribs 25*a* and 25*b* are located along the opposite lateral side panels 17 and 19, respectively. These inwardly projecting ribs combined in the closed container to define heel and toe-receiving spaces for shoes contained in interior space 20. Thus, with reference to FIG. 2, on one lateral side of inwardly projecting rib 23*a* is an outwardly projecting space labeled 24*a*. Likewise, on one lateral side of inwardly projecting rib 23*b* is an outwardly projecting space 24*b*. The spaces 24*a* and 24*b* combine, when the container is closed, to define a heel-receiving space for shoe 12*b* (FIG. 1). An outwardly projection space 26*a* and 26*b* similarly combine, when the container is closed, to define a toe-receiving space for shoe 12*b*.

The interior space in the container is configured to similarly receive and snuggly hold the other shoe of the pair, shoe 12*a*. Thus, a toe-receiving space for shoe 12*a* is defined by the combination of outwardly projecting spaces 28*a* and 28*b* (located on the opposite side of inwardly projecting rib 23*a*) when the container is closed. The heel of shoe 12*a* is received into the space defined by outwardly projecting spaces 30*a* and 30*b*.

Finally, each half of the container includes an inwardly projecting portion that defines the carrying handle. With respect to body half 14, the inwardly projecting portion is formed in top panel 21 and is labeled 32*a*. The corresponding inwardly projecting portion for body half 16 is formed in top panel 29 and is labeled 32*b*. These structural features contribute to the non-uniform interior space 20 that holds the shoes, and are part of an integrally formed handle 34. When the halves are closed as shown in FIG. 1, the inwardly projecting portions 32*a* and 32*b* align to define an inward projection that rests in the instep of shoe 12*a*.

The interior space 20 as described above securely and snuggly holds the pair of shoes 12 so that they are fully visible through the container and they are relatively immovable relative to one another and the container. Because the shoes are held snuggly within the container, a sheet of tissue-type paper such as that typically used for separating shoes in a box is not necessary. Those of ordinary skill in the art will appreciate that the particular non-uniform shape of the interior space may vary widely from the shape shown in the Figures, and will depend upon factors such as the size and style of shoes, the shoe-to-shoe orientation in the container, etc. The invention is not limited to any particular non-uniform interior configuration.

When container 10 is formed in a single piece comprising two halves 14 and 16 as illustrated, a living hinge 18 is defined by the material interconnecting the two halves. The material used to fabricate the container is preferably selected to allow the hinge to be opened and closed many times without damaging the hinge. The halves are fabricated so that when closed, the container halves are held firmly together to protect from inadvertent opening. Both halves of the container include an outwardly projecting peripheral flange. This flange on half 14 is labeled with reference numeral 36. The flange on half 16 is labeled with reference numeral 38. Immediately inwardly of flange 36 and extending around half 14 is a peripherally extending raised edge 40 that extends around body half 14. A cooperative peripherally extending recess 42 extends around body half 16. When the two body halves 14 and 16 are closed—that is, moving the halves from the position shown in FIG. 2 into the position shown in FIG. 1—raised edge 40 mates with and is received into recess 42, and flanges 36 and 38 align to define a combined peripheral flange 44 (FIG. 1). There is a friction fit between raised edge 40 and recess 42, which contributes to holding the two halves in the closed position of FIG. 1. The friction fit between the two halves is aided by a plurality of elongate tabs 45 formed around the periphery of raised edge 40 in body half 14. When the body halves are closed, the elongate tabs 45 are received into cooperatively formed outwardly projecting elongate cups 47 spaced around the periphery of recess 42 in body half 16.

Locator posts 46 and 48 are formed on opposite sides of handle 34 in half 16. When closed, locator posts 46 and 48 are received into cooperatively formed and positioned recesses 50 and 52 formed in half 14. The locator posts and recesses serve to align the halves into the proper orientation when they are closed, and to assist with keeping the container closed.

As noted above, a handle 34 is integrally formed as part of the container. The handle is conveniently located so that the container may be carried out of the store with the shoes held inside—visible to all who might see them. The shoe retailer can thus eliminate the use of shopping bags. Moreover, because the container is clear, other consumers can see what kind of shoes the consumer purchased. This is an added marketing advantage to shoe manufacturers—the shoe container not only serves the traditional functions of protecting the shoe during shipping and storage, but the container helps sell more shoes.

Figure 6:
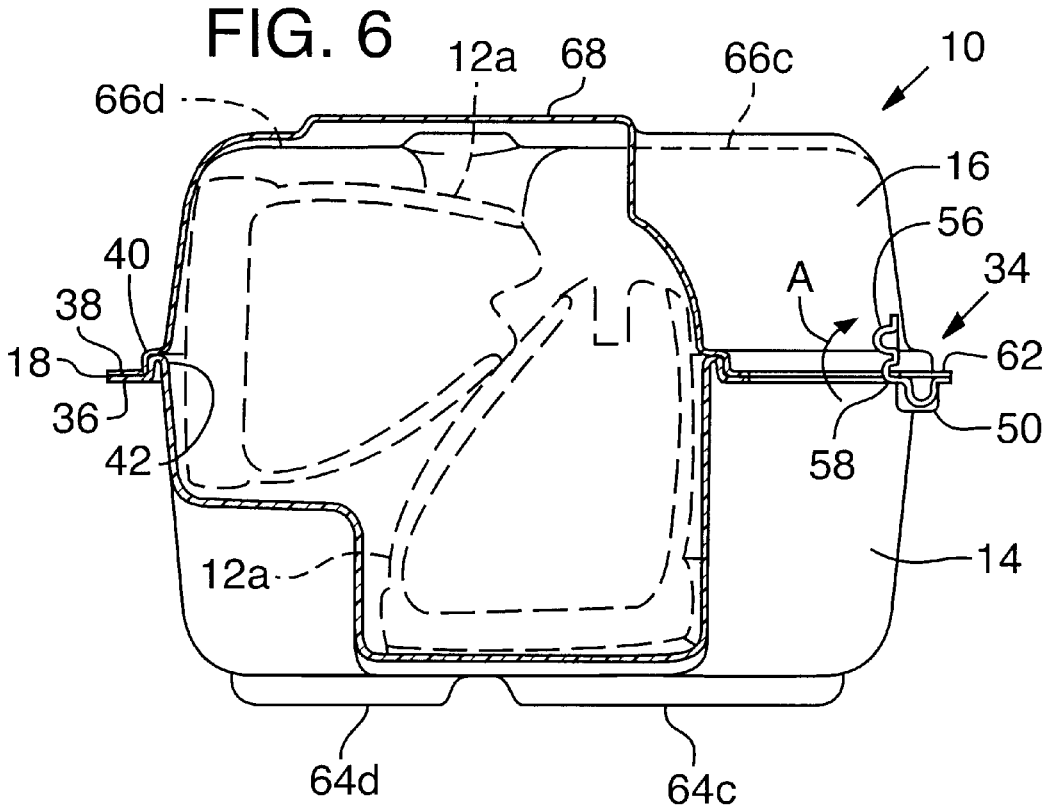
FIG. 6 is a side cross sectional view taken along the line 6—6 of FIG. 5A, showing a pair of athletic shoes held within the closed container in phantom lines.
Figure 5A:
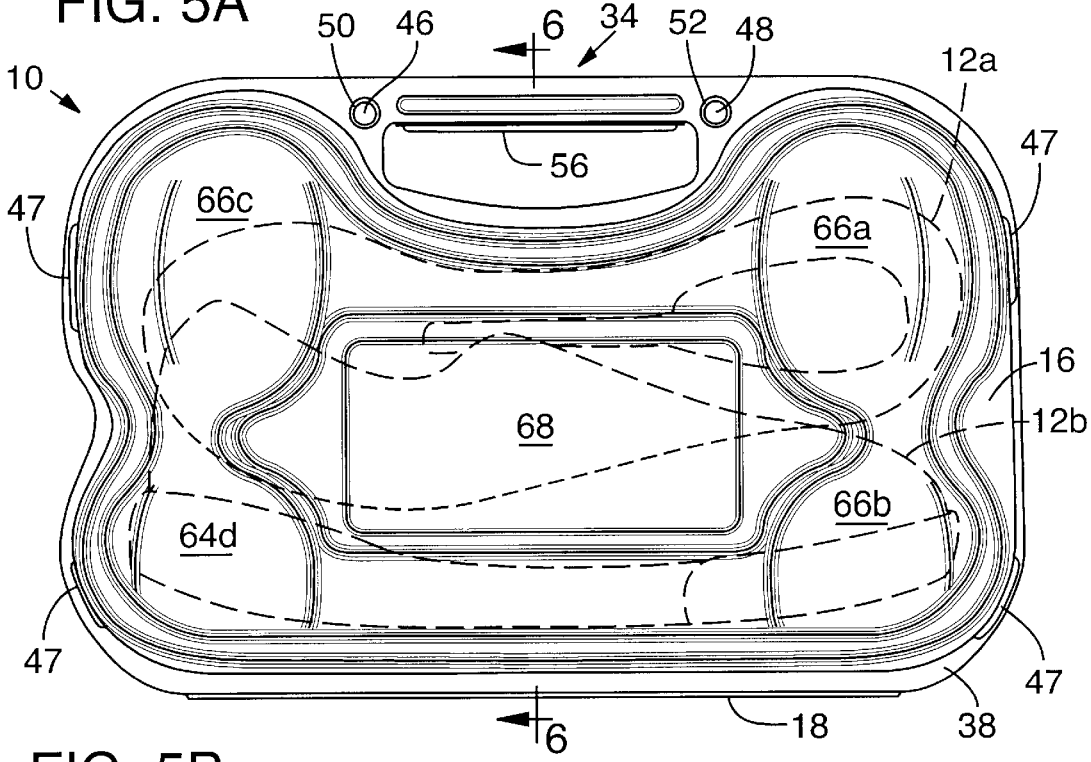
FIG. 5A is a top plan view of the closed container shown in FIG. 1, showing a pair of athletic shoes held within the closed container in phantom lines.
Figure 5B:
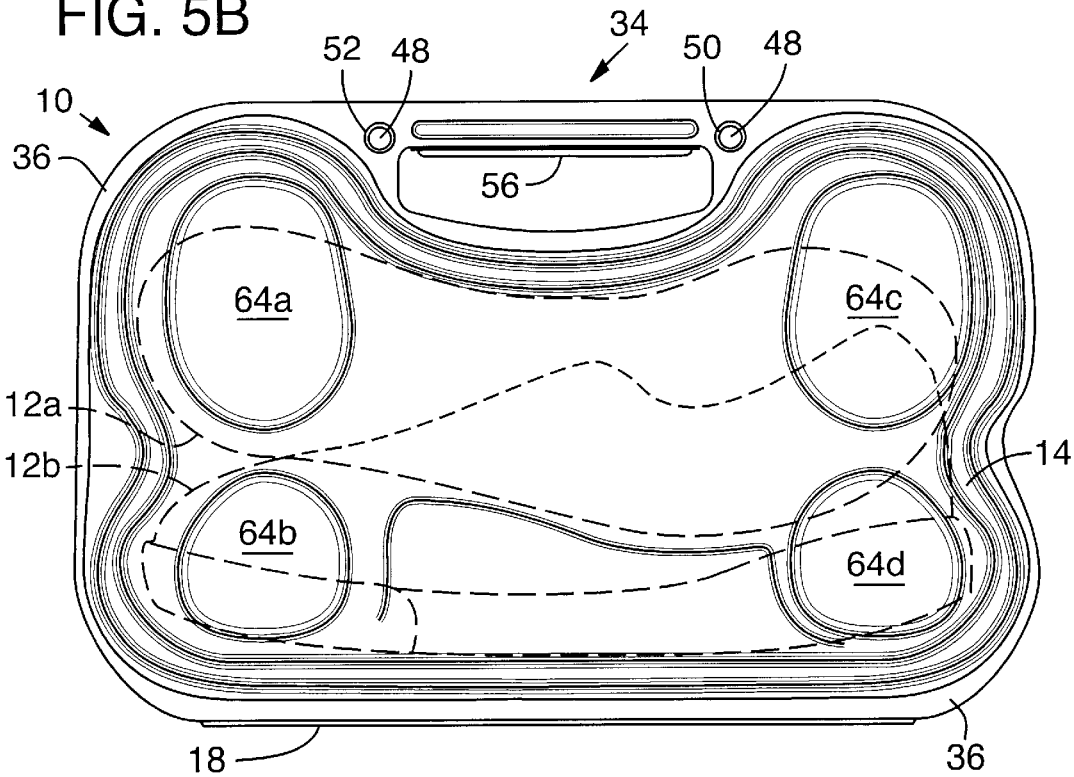
FIG. 5B is a bottom plan view of the container shown in FIG. 5A.

The handle 34 is best illustrated in FIGS. 2 and 6. Handle 34 is defined when the two halves are closed into the position shown in FIG. 1. With reference to FIGS. 2 and 6, a handle opening 54 is formed in body half 14 (for instance, by cutting the material in the blank sheet that is used to form the container before or after the container is formed). A handle flap 56 is formed in body half 14 immediately adjacent opening 54. Handle flap 56 is connected along one edge thereof by a hinge 58 that extends across the handle flap. A handle opening 60 is formed in body half 16 in a position that corresponds to the position of handle opening 54 in body half 14, thereby defining a handle segment 62. When the two halves 14 and 16 are closed together (FIG. 6) such that locator posts 46 and 48 are received into recesses 50 and 52, handle opening 54 aligns with handle opening 60. Handle flap 56 may then be folded through the handle opening between the closed and joined body halves, around handle segment 62 in the direction illustrated by arrow A. This structure provides a smooth edge for the handle 34 defined by the closed halves. As shown in FIG. 6, the handle flap 56 may be formed with longitudinal ribs extending across the handle to provide for more comfort when the container is carried. The longitudinal ribs eliminate sharp edges and provide a more comfortable carrying handle.

Handle 34 is an optional feature of the container that may be eliminated if desired. Moreover, the container may easily be fabricated to accommodate a handle that comprises a separate structure that is removably attachable to the container. With this system the end user may determine whether a handle should be used.

As noted above, container 10 is formed so that many containers may be stacked atop of one another in a stable stack, yet so that a selected container may be pulled out of the stack without unstacking the stack or upsetting the stability of the stack. The container thus includes stack stabilization structure to temporarily and removably interconnect two adjacent containers in a stack to prevent undesired relative movement between the containers in the stack. To facilitate the stable stacking feature of the present invention, the container is formed with outwardly extending protrusions or "feet" in one body half, and inwardly extending indentations or "recesses" in the other body half (again, the direction "outward" referring to the relative direction from the center of the closed container). When closed containers are stacked, the feet on one half are received into the recesses in the other half. This temporary interconnection prevents unwanted relative movement between the stacked containers. However, the feet and recesses are formed such that stacked containers may be separated from one another relatively easily.

Figure 7:
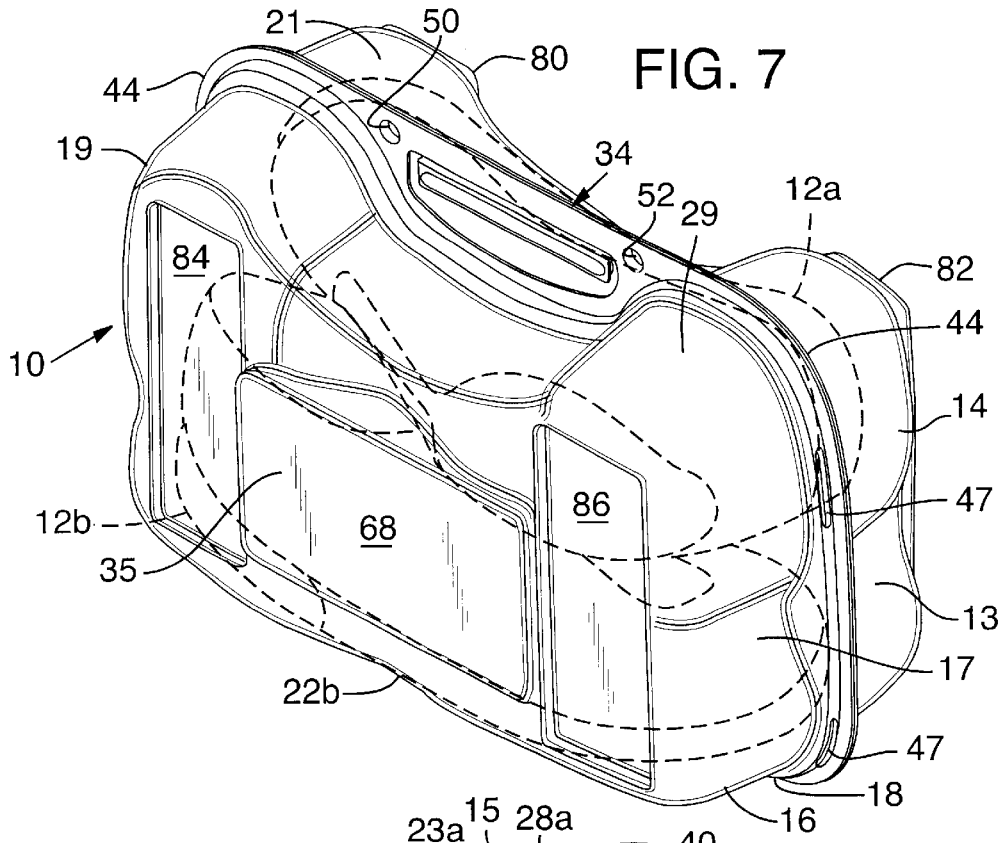
FIG. 7 is a perspective view of a footwear container according to the present invention similar to the embodiment illustrated in FIG. 1 and illustrating an alternate embodiment of the stack stabilizing feature, and showing a pair of athletic shoes held within the closed container in phantom lines.
Figure 8:
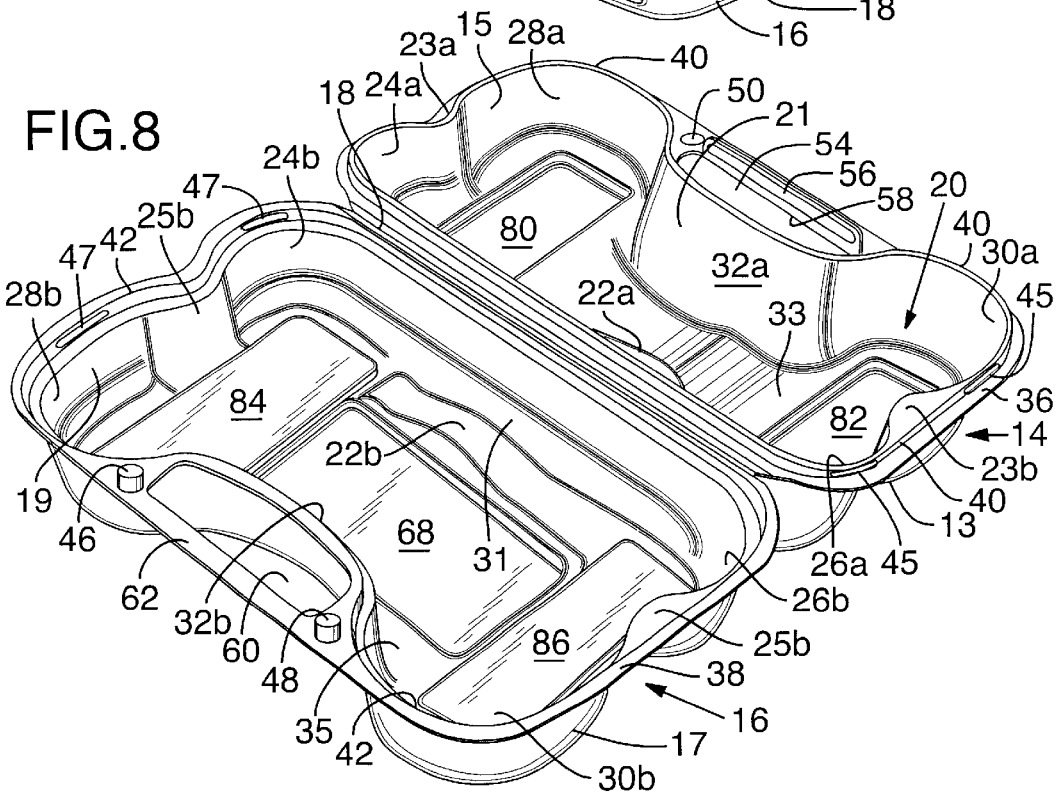
FIG. 8 is a perspective, top view of the footwear container shown in FIG. 7 with the container in an open position.

There are numerous structures that may be utilized to define the stack stabilization feature. One embodiment of the stack stabilization feature is shown in FIGS. 1 through 6. A second embodiment is shown in FIGS. 7 and 8. Each is described below.

Figure 3:
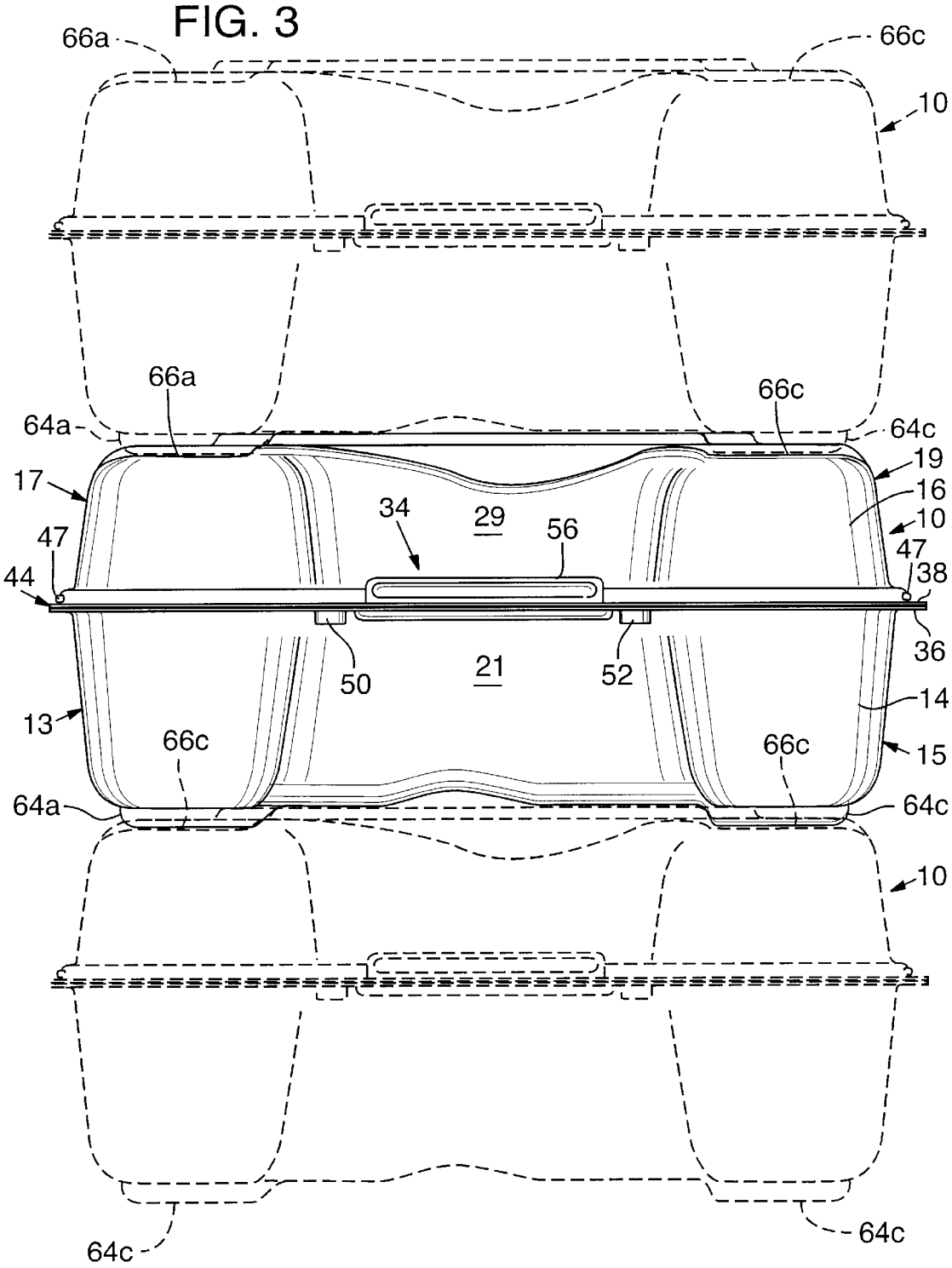
FIG. 3 is a front elevational view of the handle edge of the closed footwear container shown in FIG. 1 and illustrating a stack of three containers.
Figure 4A:
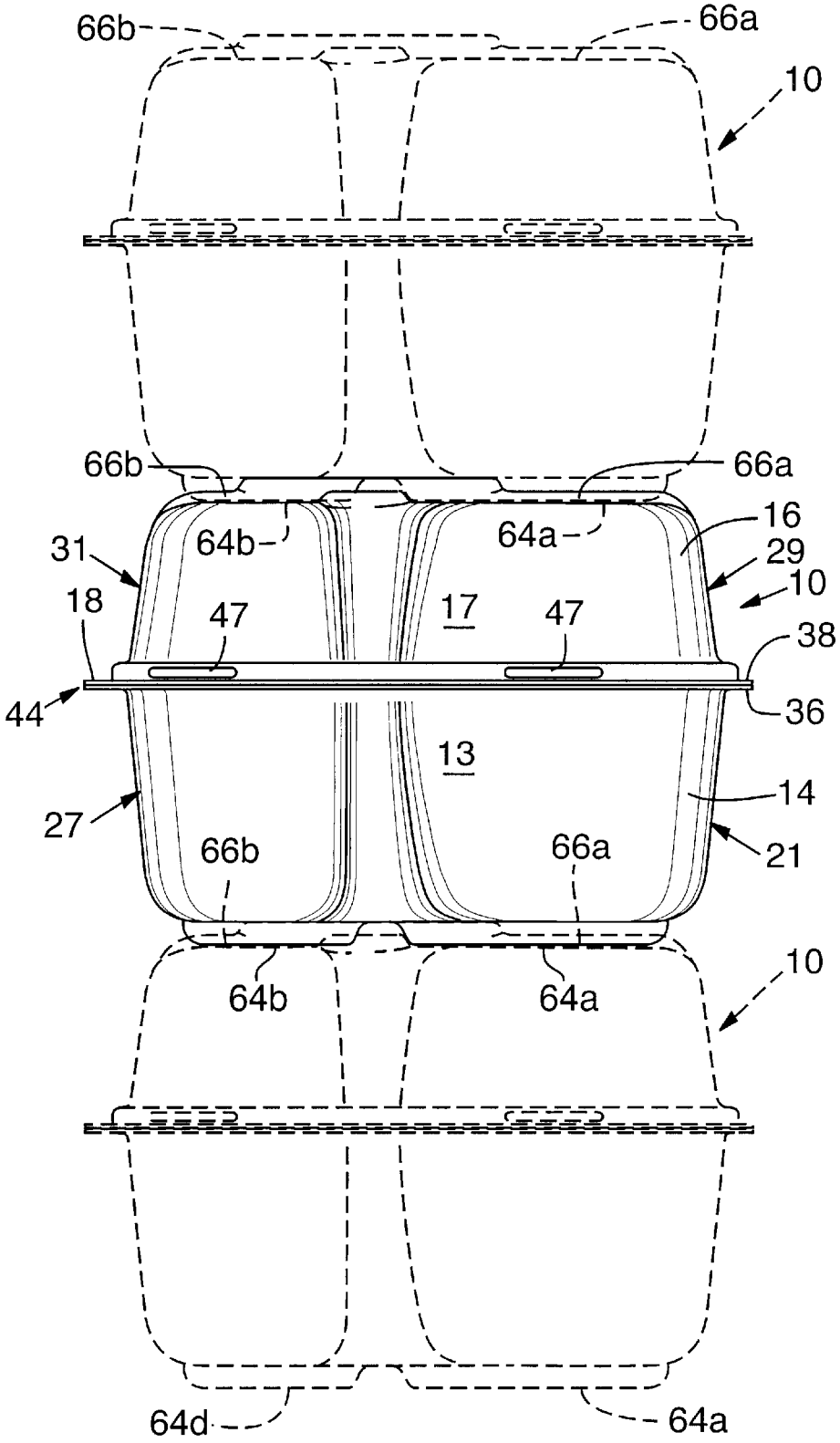
FIG. 4A is a right side elevational view of the stack of three closed containers shown in FIG. 3.
Figure 4B:
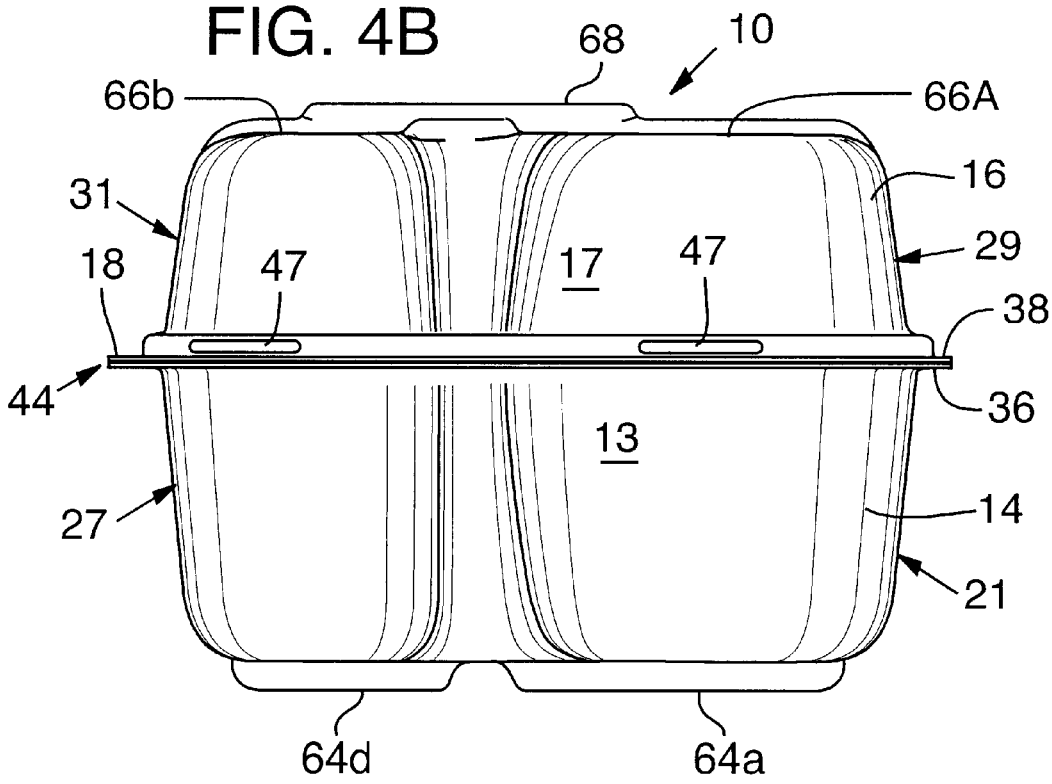
FIG. 4B is right a side elevational view of a closed footwear container according to the present invention.

With reference to FIGS. 1 and 2, four feet 64*a*, 64*b*, 64*c* and 64*d* are formed in the main panel 33 of body half 14 spaced around the periphery of the panel. When the body half is laid on a flat surface, these four feet provide a stable platform for the container. The four recesses are formed in main panel 35 of body half 16 in positions that correspond to the positions of the four feet formed in body half 14. Thus, recesses 66*a*, 66*b*, 66*c* and 66*d* are formed in body half 16 in positions spaced around the periphery of the panel that correspond to the relative positions of feet 64 in body half 14. When multiple closed containers 10 as illustrated in FIGS. 3 and 4A are stacked, feet 64 of one container are received and are nested into recesses 66 in the next adjacent container to form a stable stack. As illustrated, the height of feet 64 measured from the outer surface of main panel 33 is substantially the same and the depth of recesses 66 measured from the outer surface of main panel 35. This height and depth is controlled so that a container 10 located anywhere in the stack may easily be removed from the stack, in any direction.

Those of ordinary skill in the art will readily recognize that there are numerous alternative and equivalent structures that may be utilized to facilitate stable stacking of multiple containers, yet allowing easy removal of any particular container from the stack. For example, the system of feet and recesses described above may be modified such that the separate feet could be replaced with rails formed in one body half, and cooperative indentations formed in the opposite. Another alternative would be to utilize a system of posts and receptacles for the posts. The invention is thus not limited to the particular feet and recess system of the preferred embodiment.

The embodiment shown in FIGS. 7 and 8 uses a "rail" system to define the stack stabilization structure. Referring to FIGS. 7 and 8, two outwardly protruding rails 80 and 82 are formed in the main panel 33 of body half 14 at opposite sides of the panel. When the body half is laid on a flat surface, these two rails define a stable platform for the container. Two complementary recesses are formed in main panel 35 of body half 16 in positions that correspond to the positions of the two rails formed in body half 14. Thus, recesses 84 and 86 are formed in body half 16 at opposite sides of panel 35 in positions corresponding to the relative positions of rails 80 and 82 in body half 14. When multiple closed containers 10 as illustrated in FIGS. 3 and 4A are stacked, rails 80 and 82 of one container are received and are nested into recesses 84 and 86 in the next adjacent container to form a stable stack. As with FIGS. 1 through 6, the height of rails measured from the outer surface of main panel 33 is substantially the same and the depth of recesses measured from the outer surface of main panel 35. This height and depth is controlled so that a container 10 located anywhere in the stack may easily be removed from the stack, in any direction.

To further enhance the product-promotion aspects of the current invention, the container includes a "logo" panel 68 formed in main panel 35 of body half 16. Logo panel 68 is intended for prominent placement of written indicia formed integrally into the container during the thermoforming process. Typically, logo panel 68 would include written indicia such as trademarks, but could include any indicia such as manufacturing and sizing information. Logo panel 68 is preferably formed through use of a drop in panel in the tool or mold used to thermoform the container. This facilitates the use of a single tool, yet allows interchangeability of the written indicia on panel 68. Written indicia may be placed anywhere on the container, and also may be applied to the container with adhesive labels and the like.

As noted earlier, in a preferred embodiment the container is formed in a single piece having two body halves connected by a living hinge in a clamshell package. However, the container could just as well be fabricated with body halves defined by separate pieces that are interconnected when desired. The use of a hinge is thus optional.

Preferably, container 10 is sized such that one container will fit several different sizes of shoes. Thus, as one example, a blank container could be designed to hold a specific style of shoes (such as athletic shoes) in the size range of men's sizes 7 to 9 (in the traditional U.S. sizing system), and also women's athletic shoes in sizes 9 to 11. And while the container of the present invention is generally smaller than traditional rectangular shoeboxes designed for the same sizes of shoes, it is close enough in size so that it may be used without modification to the existing shoe distribution, warehousing and sale infrastructure.

The blank or empty containers are designed so that they may be nested with other blanks. The container 10 illustrated in FIG. 2 thus could be stacked and nested with other containers for ease of shipping and to minimize the space required for shipping many empty containers. In the embodiment illustrated, the containers may be nested to approximately 98%. That is, 98% of one container nests within the next adjacent container. It will be appreciated that with this configuration many blanks may be shipped to a shoe manufacturing facility in a minimal amount of space, and much less space than would be occupied by an equal number of paperboard box blanks. Further, the container of the present invention is ready for use and does not need to be built or set up by the shoe manufacturer. This saves on both labor and equipment costs.

Those of skill in the art will further recognize the many different shapes that can be used to define a container equivalent to the container described herein. Thus, to name but a few examples, the container could be formed with more than one handle, the shoe-receiving space inside of the container may be designed to conform more uniquely to a specific style of shoe, and as noted previously, there are numerous methods of facilitating stacking in stable stacks. Moreover, while numerous different shapes are envisioned for both the interior space of the container and the overall container shape, in the preferred embodiment the container is roughly equivalent in size and shape to a standard shoebox for holding a pair of shoes of similar size. In this way the container of the present invention is accommodated easily into existing footwear manufacturing, distribution and sales infrastructure.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. A footwear container for packaging a pair of shoes, each shoe of the pair including a heel, a toe and an instep, comprising:

a base having opposed lateral side panels interconnected by a top and a bottom panel and a main panel;

a lid having opposed lateral side panels interconnected by a top and a bottom panel and a main panel, said lid sized to matingly engage the base;

a hinge interconnecting said base and said lid between said base bottom panel and said lid bottom panel and permitting said lid and base to be selectively moved between open and closed positions;

said base and lid when in the closed position defining an open interior space wherein each of said lateral side panels of said base and each of said lateral side panels of said lid include a rib portion that projects inwardly into said interior space such that when the lid and base are in the closed position the rib portions on the base align with the rib portions on the lid to cooperatively define two separate outwardly projecting spaces along each of said side panels, one of said outwardly projecting spaces on one side panel for receiving the toe of one shoe of a pair of shoes and the other of said outwardly projecting spaces on said one side panel for receiving the heel of the second shoe of a pair of shoes contained in the interior space;

wherein said bottom panel of said base includes a curved shelf projecting inwardly into said interior space and said main panel of said lid includes a cooperatively curved shelf proximate said lid bottom panel projecting inwardly into said interior space so that when said base and lid are in the closed position the curved shelf on the base bottom panel and the curved shelf on the lid main panel cooperate to define a support for receiving the instep of the first shoe of said pair; and wherein at least a portion of said base or said lid is fabricated from a clear material.

2. The footwear container according to claim 1 wherein said interior space is configured to receive to a pair of shoes oriented with respect to one another in a heel-to-toe arrangement and wherein the second shoe of said pair is rotated relative to the first shoe in said pair by about 90° about the longitudinal axis extending through said shoes.

3. The footwear container according to claim 1 wherein said hinge is a living hinge.

4. The footwear container according to claim 3 wherein said base and said lid define peripheral edges and including means along said peripheral edges for joining said base and said lid when the container is in the closed position.

5. The footwear container according to claim 4 wherein said means along said peripheral edges further comprises a raised peripheral edge formed along the peripheral edge of said base and a cooperatively formed recess formed along the peripheral edge of said lid, said raised peripheral edge of said base cooperatively formed to matingly engage said peripheral recess of said lid.

6. The footwear container according to claim 1 including a carrying handle.

7. The footwear container according to claim 5 wherein said handle is integrally formed as part of said container.

8. The footwear container according to claim 1 including means for preventing relative movement between adjacent containers when more than one containers are stacked atop one another.

9. The footwear container according to claim 8 wherein said means for preventing relative movement between adjacent containers further comprises plural outwardly projecting feet in the container lid main panel of a first container and like number of cooperatively formed inwardly projecting receptacles formed in the container base main panel of a second container, said each of said inwardly projecting receptacles sized to receive one of said outwardly projecting feet when said first and second containers are stacked.

10. The footwear container according to claim 3 wherein when said container is in said closed position, said hinge is located approximately medially between said lid main panel and said base main panel.

11. The footwear container according to claim 3 wherein when said container is in said closed position, said hinge is located non-medially between said lid main panel and said base main panel.

12. The footwear container according to claim 1 formed in one piece.

13. The footwear container according to claim 1 formed entirely of a clear material.

14. The footwear container according to claim 13 wherein at least some of said container is colored.

15. The footwear container according to claim 1 including written indicia thereon.

16. The footwear container according claim 15 wherein said written indicia comprises a trademark.

17. A container for holding a pair of shoes in an interior of the container, comprising:

a base having opposed lateral side panels interconnected by a top and bottom panel and a main panel, each lateral side panel having a rib portion projecting inwardly toward the container interior;

a lid sized to matingly engage the base to define an open interior space having non-uniform dimensions, said lid having opposed lateral side panels interconnected by a top and bottom panel and a main panel, each lateral side panel having a rib portion projecting inwardly toward the container interior, said lid and said base formed in an integral piece and interconnected by a hinge, extending between and connecting the base bottom panel to the lid bottom panel and wherein at least a portion of said base or said lid is clear;

wherein when the base and lid are movable about said hinge between an open position and a closed position and in the closed position the inwardly projecting rib portions on the base align with the inwardly projecting rib portions on the lid to cooperatively define an outwardly projecting space on either side of said aligned rib portions; and wherein said bottom panel of said base includes a curved shelf projecting inwardly into said interior space and said main panel of said lid includes a cooperatively curved shelf proximate said lid bottom panel projecting inwardly into said interior space so that when said base and lid are in the closed position the curved shelf on the base bottom panel and the curved shelf on the lid main panel cooperate to define a support for receiving the instep of one shoe of said pair.

18. The container of claim 17 wherein the entire container is clear.

19. The container of claim 17 including a carrying handle.

20. The container of claim 17 further including means for temporarily interconnecting the lid main panel on a first container to the base main panel on a second container to prevent undesired relative movement therebetween when said first and second containers are stacked.

21. The container of claim 20 wherein said means for temporarily interconnecting comprises outwardly projecting portions on said lid main panel and indentations formed on said base main panel positioned to receive said outwardly projecting portions when said first and second containers are stacked.

* * * * *